US006599043B2

(12) United States Patent
Kobayashi et al.

(10) Patent No.: US 6,599,043 B2
(45) Date of Patent: Jul. 29, 2003

(54) CONTROL METHOD FOR SHEET MEMBER CONVEYING APPARATUS AND CONTROL METHOD FOR RECORDING APPARATUS

(75) Inventors: Nobutsune Kobayashi, Kanagawa (JP); Michiharu Shoji, Kanagawa (JP); Hiroyuki Saito, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/983,725

(22) Filed: Oct. 25, 2001

(65) Prior Publication Data

US 2002/0051028 A1 May 2, 2002

(30) Foreign Application Priority Data

Oct. 31, 2000 (JP) ..... 2000-332713

(51) Int. Cl.[7] ..... B41J 11/42; B41J 2/01

(52) U.S. Cl. ..... 400/582; 347/19; 347/104; 400/625

(58) Field of Search ..... 400/578, 582, 400/161.2, 161.4, 568, 569, 567, 625, 636.2, 648, 708, 226, 271, 158, 158.1, 611; 347/19, 16, 104; 101/484

(56) References Cited

U.S. PATENT DOCUMENTS 4,228,396 A * 10/1980 Palombo et al. ..... 324/163
5,880,570 A * 3/1999 Tamaki et al. ..... 318/700
6,428,224 B1 * 8/2002 Askren et al. ..... 400/582

OTHER PUBLICATIONS

U.S. patent application Ser. No. 09/905,876, filed Jul. 17, 2001, pending.
U.S. patent application Ser. No. 09/983,724, filed Oct. 25, 2001, pending.
U.S. patent application Ser. No. 09/983,578, filed Oct. 25, 2001, pending.

* cited by examiner

*Primary Examiner*—Andrew H. Hirshfeld
*Assistant Examiner*—Hoai-An D. Nguyen
(74) *Attorney, Agent, or Firm*—Fitzpatrick, Cella, Harper & Scinto

(57) ABSTRACT

In a sheet member conveying apparatus having a roller for conveying a sheet member, a motor for driving the roller, a driving transmitter for transmitting a driving force of the motor to the roller, and a detector for detecting position and speed of the roller, control is executed by a step of detecting a periodic speed or torque change of the roller as a period profile, a step of judging a specific phase angle in the period profile as an origin, a step of correlating an offset phase angle having a specific offset from the origin with an optimal suspension phase angle on the period profile, which is a phase angle to suspend the roller, and a step of controlling the suspension phase angle on the period profile at which the roller is suspended to become optimal, thereby suppressing an influence by torque and speed changes of the motor.

22 Claims, 13 Drawing Sheets

FIG. 5

| PHASE ANGLE (DEGREE) | CHANGE IN SPEED (%) |
|---|---|
| 0.00 | 9 |
| 2.25 | 0 |
| 4.50 | 0 |
| 6.75 | −4 |
| 9.00 | 0 |
| 11.25 | 9 |
| 13.50 | 17 |
| 15.75 | 21 |
| 18.00 | 17 |
| 20.25 | 9 |
| 22.50 | 4 |
| 24.75 | 0 |
| 27.00 | 0 |
| 29.25 | 17 |
| 31.50 | 30 |
| 33.75 | 30 |
| 36.00 | 30 |
| 38.25 | 21 |
| 40.50 | 4 |
| 42.75 | 0 |
| 45.00 | −4 |
| 47.25 | −9 |
| 49.50 | −9 |
| 51.75 | −4 |
| 54.00 | −9 |
| 56.25 | −21 |
| 58.50 | −34 |
| 60.75 | −17 |
| 63.00 | −17 |
| 65.25 | −21 |
| 67.50 | −26 |
| 69.75 | −30 |
| 72.00 | −55 |
| 74.25 | −73 |
| 76.50 | −95 |
| 78.75 | −95 |
| 81.00 | −81 |
| 83.25 | −69 |
| 85.50 | −43 |
| 87.75 | −21 |
| 90.00 | −13 |
| 92.25 | −30 |
| 94.50 | −55 |
| 96.75 | −73 |
| 99.00 | −81 |
| 101.25 | −69 |
| 103.50 | −38 |
| 105.75 | −9 |
| 108.00 | 9 |
| 110.25 | 0 |
| 112.50 | −4 |
| 114.75 | −30 |
| 117.00 | −43 |
| 119.25 | −17 |
| 121.50 | 0 |
| 123.75 | 9 |
| 126.00 | 21 |
| 128.25 | 13 |
| 130.50 | 9 |
| 132.75 | 4 |
| 135.00 | −4 |
| 137.25 | −4 |
| 139.50 | 4 |
| 141.75 | 13 |
| 144.00 | 26 |
| 146.25 | 17 |
| 148.50 | 13 |
| 150.75 | 4 |
| 153.00 | 0 |
| 155.25 | 4 |
| 157.50 | 0 |
| 159.75 | 9 |
| 162.00 | 17 |
| 164.25 | 17 |
| 166.50 | 30 |
| 168.75 | 21 |
| 171.00 | 17 |
| 173.25 | 17 |
| 175.50 | 21 |
| 177.75 | 13 |
| 180.00 | 21 |
| 182.25 | 26 |
| 184.50 | 26 |
| 186.75 | 34 |
| 189.00 | 17 |
| 191.25 | 21 |
| 193.50 | 21 |
| 195.75 | 17 |
| 198.00 | 21 |
| 200.25 | 21 |
| 202.50 | 34 |
| 204.75 | 47 |
| 207.00 | 47 |
| 209.25 | 60 |
| 211.50 | 64 |
| 213.75 | 64 |
| 216.00 | 69 |
| 218.25 | 55 |
| 220.50 | 60 |
| 222.75 | 77 |
| 225.00 | 81 |
| 227.25 | 90 |
| 229.50 | 98 |
| 231.75 | 90 |
| 234.00 | 86 |
| 236.25 | 60 |
| 238.50 | 52 |
| 240.75 | 43 |
| 243.00 | 43 |
| 245.25 | 52 |
| 247.50 | 47 |
| 249.75 | 38 |
| 252.00 | 17 |
| 254.25 | 0 |
| 256.50 | −13 |
| 258.75 | −17 |
| 261.00 | −17 |
| 263.25 | −13 |
| 265.50 | −13 |
| 267.75 | −9 |
| 270.00 | −17 |
| 272.25 | −30 |
| 274.50 | −34 |
| 276.75 | −34 |
| 279.00 | −34 |
| 281.25 | −26 |
| 283.50 | −17 |
| 285.75 | −26 |
| 288.00 | −34 |
| 290.25 | −34 |
| 292.50 | −47 |
| 294.75 | −47 |
| 297.00 | −38 |
| 299.25 | −26 |
| 301.50 | −17 |
| 303.75 | −17 |
| 306.00 | −30 |
| 308.25 | −47 |
| 310.50 | −60 |
| 312.75 | −47 |
| 315.00 | −21 |
| 317.25 | −4 |
| 319.50 | 0 |
| 321.75 | −13 |
| 324.00 | −26 |
| 326.25 | −30 |
| 328.50 | −30 |
| 330.75 | −21 |
| 333.00 | −4 |
| 335.25 | −4 |
| 337.50 | 0 |
| 339.75 | 0 |
| 342.00 | −4 |
| 344.25 | −9 |
| 346.50 | −13 |
| 348.75 | −13 |
| 351.00 | −4 |
| 353.25 | 9 |
| 355.50 | 13 |
| 357.75 | 9 |

CONTROL METHOD FOR SHEET MEMBER CONVEYING APPARATUS AND CONTROL METHOD FOR RECORDING APPARATUS

BACKGROUND OF THE INVENTION

1. Field of the Invention

The present invention relates to a control method for a sheet member conveying apparatus and a control method for a recording apparatus.

2. Related Background Art

In recent years, a decrease in operation sound, as well as improvement in image quality, are desired in a printer. Particularly, in an ink jet recording apparatus having few noise sources at a time of recording, a DC (direct current) motor and a linear encoder are adopted as a driving means to scan a recording head, thereby achieving a low-noise operation. In addition to this, the DC motor and a rotary encoder are being adopted nowadays as a driving means to convey sheets. Although an effect of decreasing a noise can be expected by only adopting the DC motor, highly developed suspension control techniques and machine accuracy are necessary to execute highly accurate conveying.

As a method of suspending or stopping the DC motor, basically, a method of turning off a power supply of the motor when the rotation of a roller reaches a target position and thus suspending the motor by inertia is generally used.

To secure suspension accuracy using the DC motor, it is necessary and indispensable to lower a pre-suspension speed and eliminate pre-suspension disturbance torque, i.e., to stabilize low-speed driving directly before suspension. That is, by turning off the power supply of the motor at a constant and sufficiently slow speed, a settling time being the time from the start to the suspension of rotation of the motor and suspension accuracy of the motor can be stabilized.

In such a structure, a torque change having a large period can be controlled because the disturbance torque can be eliminated by feedback control represented by generally known PID (proportional-integral-derivative) control. However, a torque change represented by a motor cogging period can not be controlled because a frequency of this torque change exceeds a frequency capable of being solved by the feedback control. This problem will be explained with reference to FIGS. 12 to 14.

FIG. 12 shows an ideal state of a driving profile of a general DC (direct current) motor in a case where tracking (or variable-value) control is used as the feedback control. In FIG. 12, the longitudinal axis indicates a control time and the lateral axis indicates a speed, and the DC motor is driven as indicated by a speed profile 001.

The motor is accelerated in an acceleration control area 002, driven at the maximum speed of the speed profile 001 in a constant speed control area 003, and decelerated in a deceleration control area 004, whereby the rotating speed of the motor reaches a directly-before-suspension speed 005 which satisfies demands of suspension accuracy performance and settling time performance directly before the rotated motor reaches a suspension position. Then, a power supply of the motor is turned off when the rotated motor reaches the target suspension position, and the motor suspends or stops by inertia.

FIGS. 13 and 14 schematically show actual operations in a case where the DC motor controlled aiming at the ideal profile as shown in FIG. 12 is influenced by the torque change. In the drawings, an angle $\alpha°$ represents a phase angle where the torque of the motor decreases because of the torque change due to the cogging, and it can be understood that an actual motor driving speed slows whenever the motor passes the point of the angle $\alpha°$ and rotates.

The difference between FIGS. 13 and 14 is a difference in a remaining driving phase amount until the motor reaches the target suspension position after it finally passed the point of the angle $\alpha°$.

In FIG. 13, since the motor instantly reaches the target suspension position after it finally passed the point of the angle $\alpha°$, there is no time to compensate speed decrease due to the torque change, whereby a somewhat too low directly-before-suspension speed 025 is given. In this case, a poor effect such as the settling time becoming long occurs.

In FIG. 14, after the motor finally passed the point of the angle $\alpha°$, it reaches the target suspension position after a while. Thus, a correction to recover the speed which decreased too much at the point of the angle $\alpha°$ is excessively executed by the feedback control, with the result that a too high directly-before-suspension speed 026 is given by reaction. In this case, a poor effect occurs such as the suspension accuracy degrading a little.

As described above, the suspension accuracy performance and the settling time performance are influenced by differences in a relative offset amount between the target suspension position and a motor cogging torque ripple phase angle, whereby there is the problem that such an influence can not be controlled because it far exceeds the frequency capable of being controlled by the feedback control.

Further, a correlation between the profile of the motor cogging torque ripple and the absolute numeric information being position information obtained from the encoder changes easily, if information in an electronic circuit is lost by power on/off, or a conveying roller is moved while power is off. Therefore, there is a problem that, if an origin judging means for correlating a specific phase angle in the profile with a specific value in the absolute numeric information and correctly judging the correlated value as an origin is not provided, the control based on recognition of the profile can not be executed.

SUMMARY OF THE INVENTION

An object of the present invention is to provide a sheet member conveying apparatus control method and a recording apparatus control method which are not influenced easily by a torque change, a speed change and the like of a motor when a sheet member such as a recording medium or the like is conveyed.

Another object of the present invention is to provide a control method for a sheet member conveying apparatus which has a conveying roller for conveying a sheet member, a conveying motor for generating a driving force to drive the conveying roller, a driving transmission means for transmitting the driving force of the conveying motor to the conveying roller, and a detecting means for detecting a position and a speed of the conveying roller, the method comprising a period profile detecting step of detecting a periodic speed change or torque change of the conveying roller as a period profile, an origin judging step of judging a specific phase angle in the period profile as an origin, a correlating step of correlating an offset phase angle having a specific offset from the origin with an optimal suspension phase angle on the period profile being a phase angle to suspend the conveying roller, and a phase managing step of controlling the suspension phase angle control so that the suspension phase angle on the period profile at which the conveying roller suspends becomes the optimal suspension phase angle.

BRIEF DESCRIPTION OF THE DRAWINGS

FIG. 5 is a data table representing a speed change ratio detected for each encoder slit by executing driving in a feedback control step of driving a conveying roller at a constant speed;

DETAILED DESCRIPTION OF THE PREFERRED EMBODIMENTS

In the present embodiment, a serial printer equipped with an ink jet head having a detachable ink tank will be explained by way of example. However, the present invention is not limited to this but applicable to a so-called line printer having a long recording head not executing a scan in a row direction of a recording medium.

Figure 1:
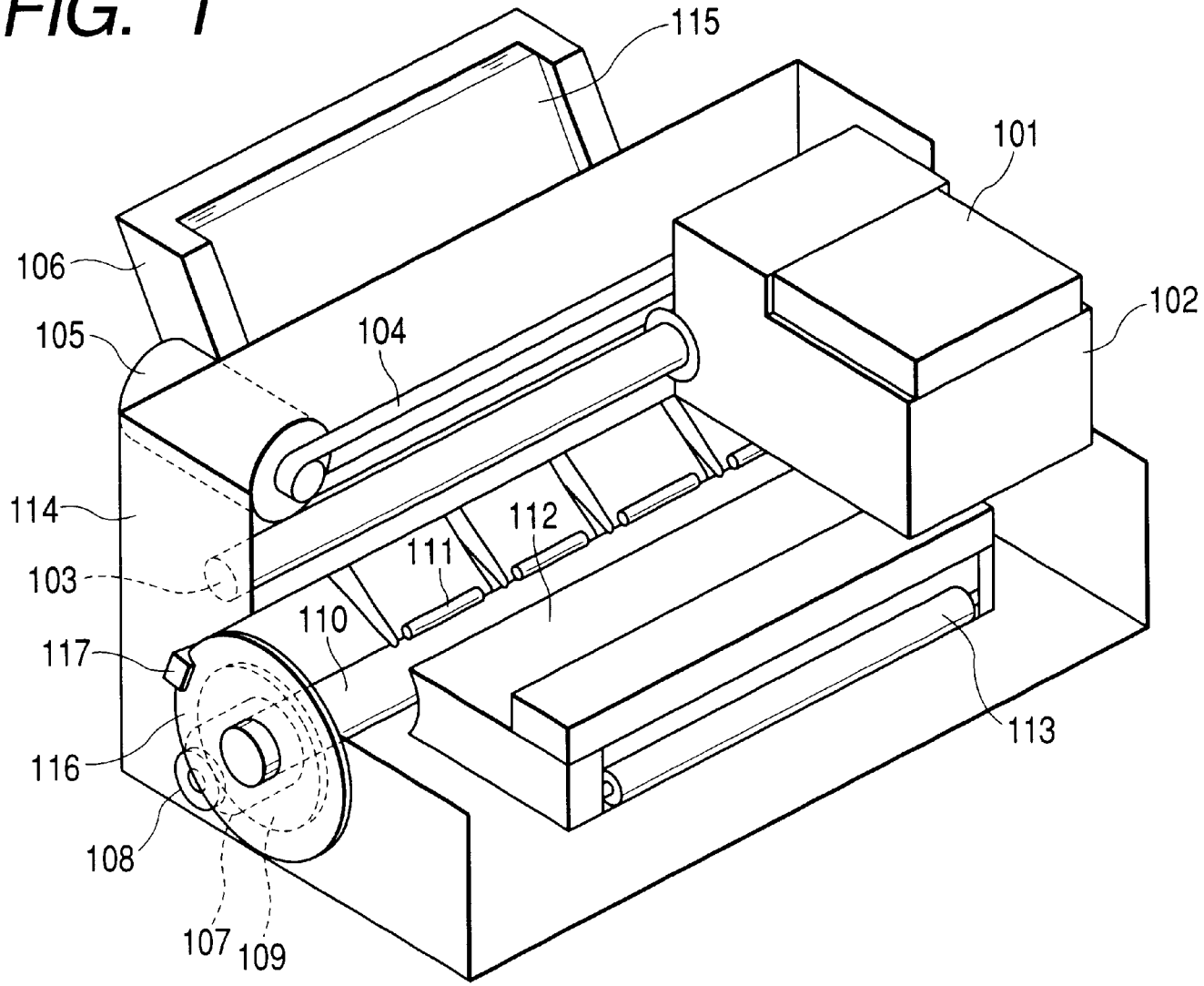
FIG. 1 is an outside perspective diagram of an ink jet printer according to the present invention.

FIG. 1 is an outside perspective diagram of the serial ink jet printer being an example of a recording apparatus to which the present invention is applied. In FIG. 1, a guide shaft 103 slidably guiding a carriage 102 in a main scan direction is fixed to a chassis 114 of the printer. A cartridge-type recording head 101 detachably having the ink tank is exchangeably mounted on the carriage 102. A belt 104 acting as a driving transmission means is engaged to the part of the carriage 102, and put (or wound) on a pulley and a rotation axis of a carriage motor 105 acting as a driving means, along the guide shaft 103. Thus, by driving the carriage motor 105, the carriage 102 equipped with the recording head 101 can be shifted in the main scan direction.

A recording sheet (recording medium) 115 which is a sheet member and fed from a sheet feeding base 106 is conveyed toward a direction intersecting the main scan direction (preferably a direction perpendicular to the main scan direction) by a conveying roller 110, and recording is then executed on a platen 112 by the recording head 101. The conveying roller 110 is rotatably attached to the chassis 114. A pinch roller 111 rotating pursuant to the conveying roller 110 is arranged on the conveying roller 110 in the state that the roller 111 is being pressurized by a pinch roller spring (not shown).

A conveying roller gear 109 is attached to the end of the axis of the conveying roller 110. A motor gear 108 attached to the rotation axis of a conveying motor 107 acting as a DC motor is engaged with the conveying roller gear 109.

A codewheel 116 is fitted into the axis of the conveying roller 110, and an encoder sensor 117 is disposed on the periphery of the codewheel 116.

As the recording head 101, a configuration that a droplet is emitted from a nozzle by using film boiling caused by thermal energy applied to liquid is applicable, and also another configuration that a thin film element is minutely displaced according to an electrical signal input thereto to cause a nozzle to emit liquid is applicable.

The recording sheets 115 are being stacked on the sheet feeding base 106 while such the printer is on standby for recording, and each sheet 115 is fed inside the apparatus by a not-shown sheet feeding roller when the recording starts. The conveying roller 110 is rotated by driving force of the conveying motor 107 acting as the DC motor through a train of gears (the motor gear 108, the conveying roller gear 109) acting as the driving transmission means, to convey the fed recording sheet 115. Then, the recording sheet 115 is conveyed by an appropriate conveying amount by the conveying roller 110 and the following pinch roller 111, and the conveying amount is controlled by detecting and counting, with the encoder sensor 117, a slit (not shown) on the codewheel (rotary encoder film) 116 at the end of the axis of the conveying roller 110, thereby enabling highly accurate conveying of the recording sheet.

Thus, while the carriage is scanned, the recording of one line is executed by causing the recording head 101 to emit ink droplets onto the recording sheet 115 pressed to the platen 112 on the basis of image information.

By alternately repeating the carriage scan and intermittent sheet conveying as above, a desired image is formed on the recording sheet 115. After the image forming has ended, the recording sheet 115 is discharged by a discharge roller 113, whereby the recording operation completes. Here, it should be noted that the phrase "recording" implies, in addition to forming of characters and figures, forming of mere diagrams having no meaning.

Figure 2:
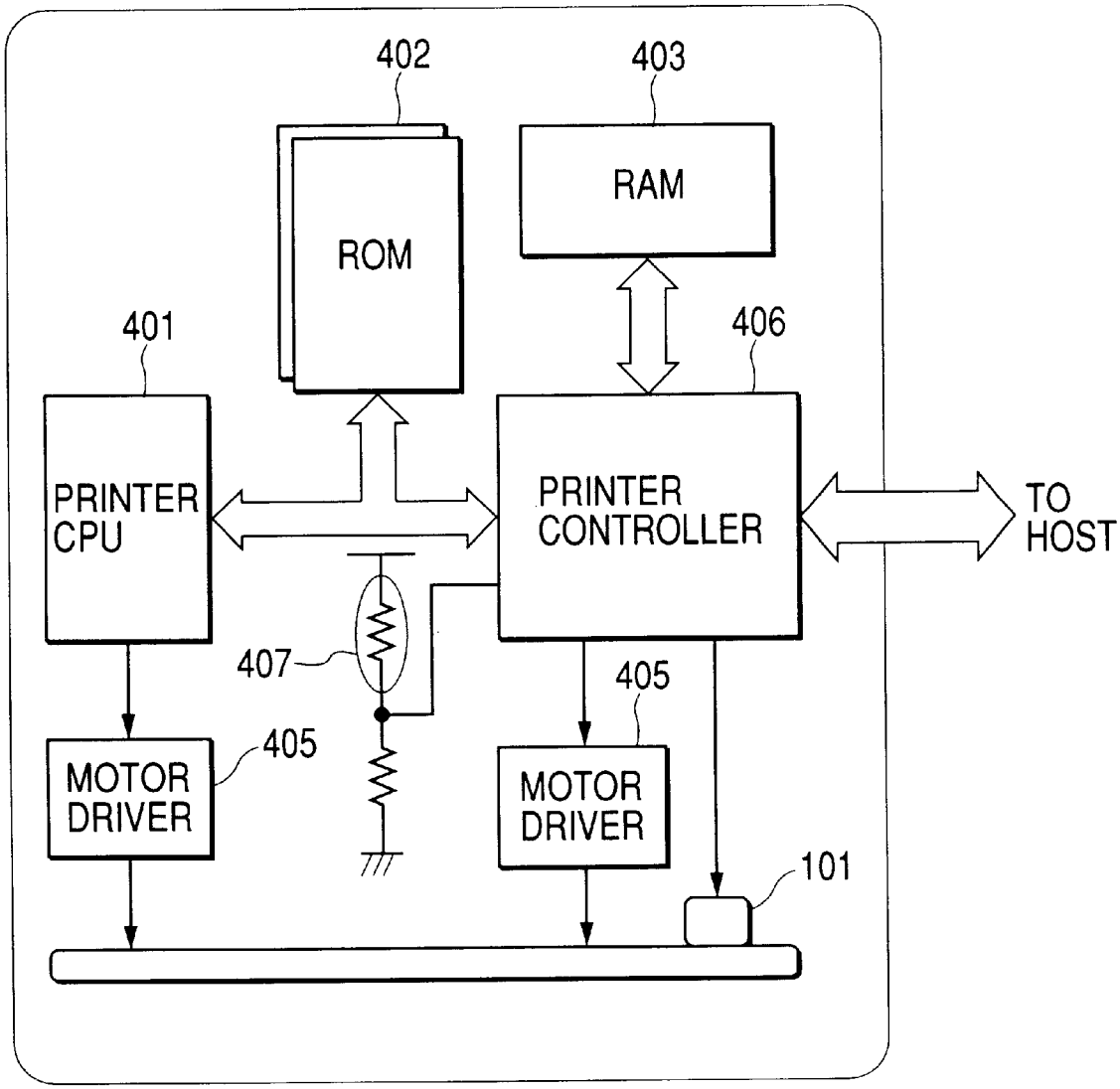
FIG. 2 is a block diagram for explaining a control structure of the printer according to the present invention.

Next, FIG. 2 is a block diagram for explaining the control structure of the recording apparatus.

A CPU 401 for controlling the printer of the recording apparatus controls a print operation by using a printer control program, a printer emulator and a recording font stored in a ROM 402.

A RAM 403 stores developed data for the recording and data received from a host apparatus. Motor drivers 405 drive the motor, and a printer controller 406 executes access control to the RAM 403, data exchange to the host apparatus and control signal sending to the motor drivers. A temperature sensor 407 composed of a thermistor and the like detects a temperature of the recording apparatus.

The CPU 401 executes mechanical/electrical control to the body of the recording apparatus according to the control program stored in the ROM 402, and also the CPU 401 reads, via an I/O register in the printer controller 406, information such as an emulation command and the like sent from the host apparatus to the recording apparatus, and then writes/reads control data corresponding to the read command to/from the I/O register and an I/O port in the printer controller 406.

Figure 3:
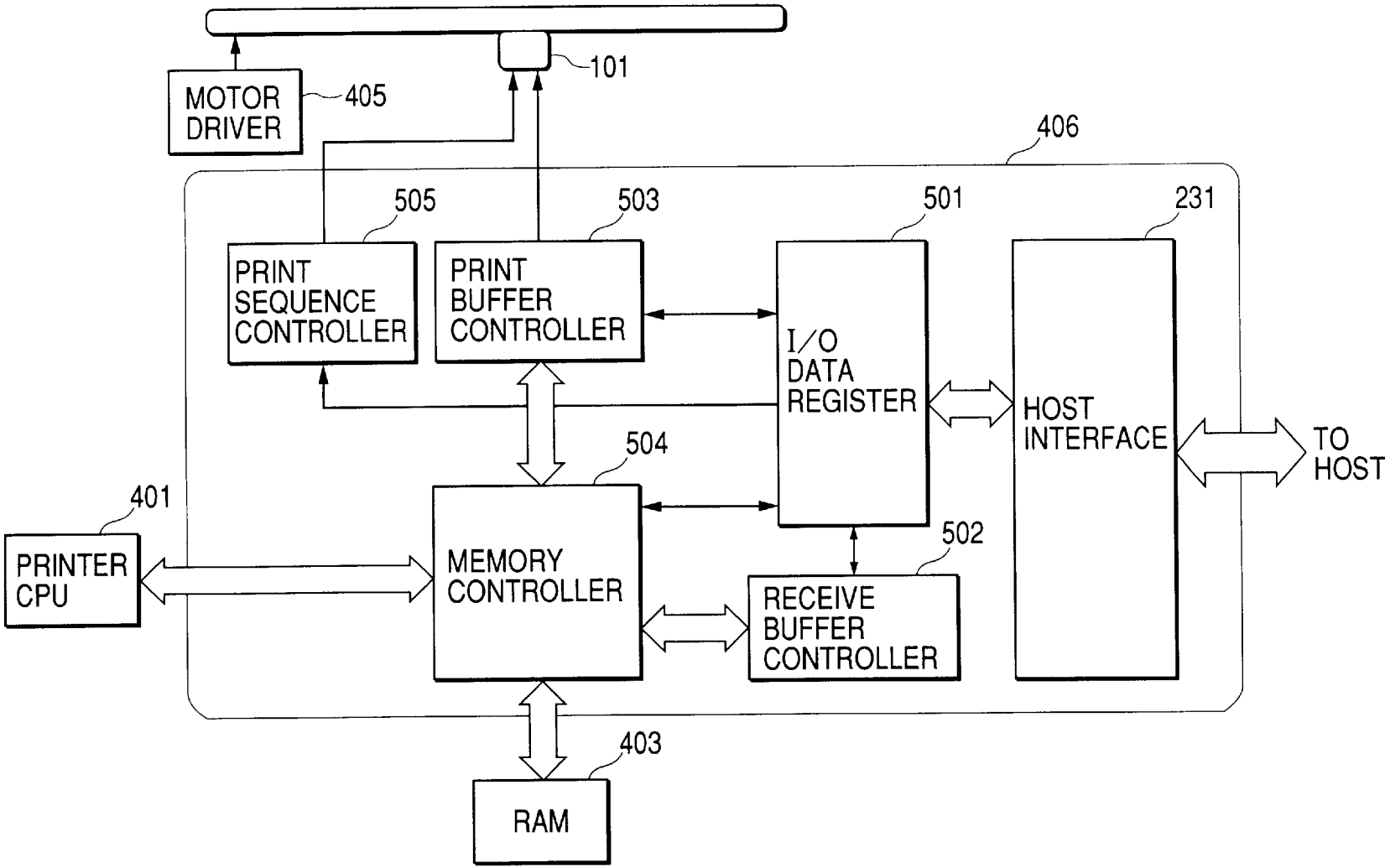
FIG. 3 is a block diagram for explaining a detailed structure of a printer controller according to the present invention.

FIG. 3 is a block diagram for explaining the detailed structure of the printer controller 406 shown in FIG. 2. In FIG. 3, the same parts as those of FIG. 2 are denoted by the same numerals as those shown in FIG. 2.

In FIG. 3, an I/O data register 501 exchanges data in a command level to the host apparatus, and a receive buffer controller 502 directly writes the received data from the I/O data register in the RAM 403.

When recording is executed, a print buffer controller 503 reads recording data from a recording data buffer of the RAM and sends the read data to the recording head 101. A memory controller 504 controls memory access in three directions for the RAM 403, a print sequence controller 505 controls a print sequence, and a host interface 231 executes communication to the host apparatus.

Figure 4:
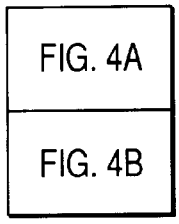
FIG. 4 is comprised of FIGS. 4A and 4B showing a flow chart of a period profile detecting step and an origin judging step of correctly judging a specific phase angle in a period profile as an origin, according to the present invention.
Figure 4A:
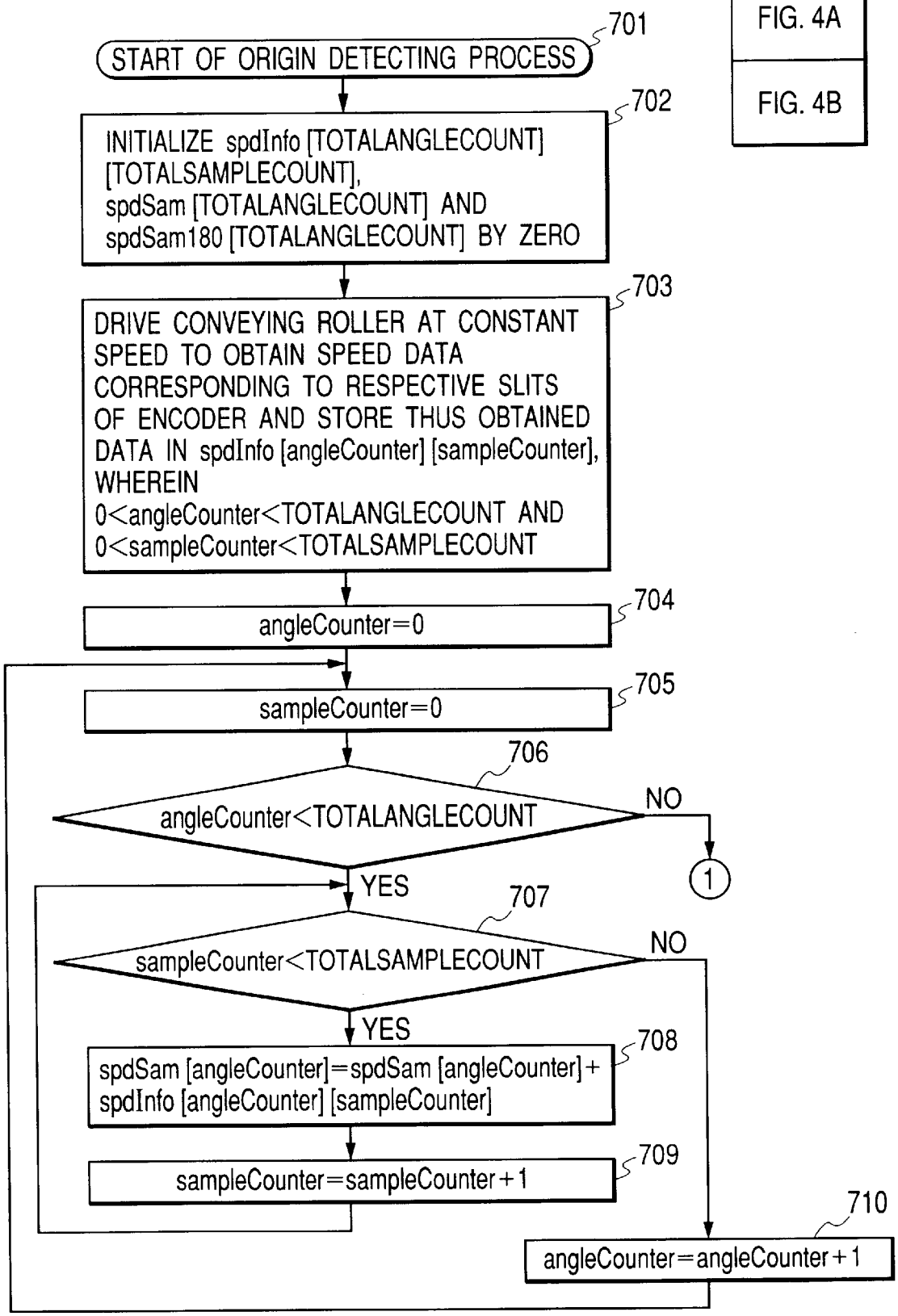
Figure 4B:
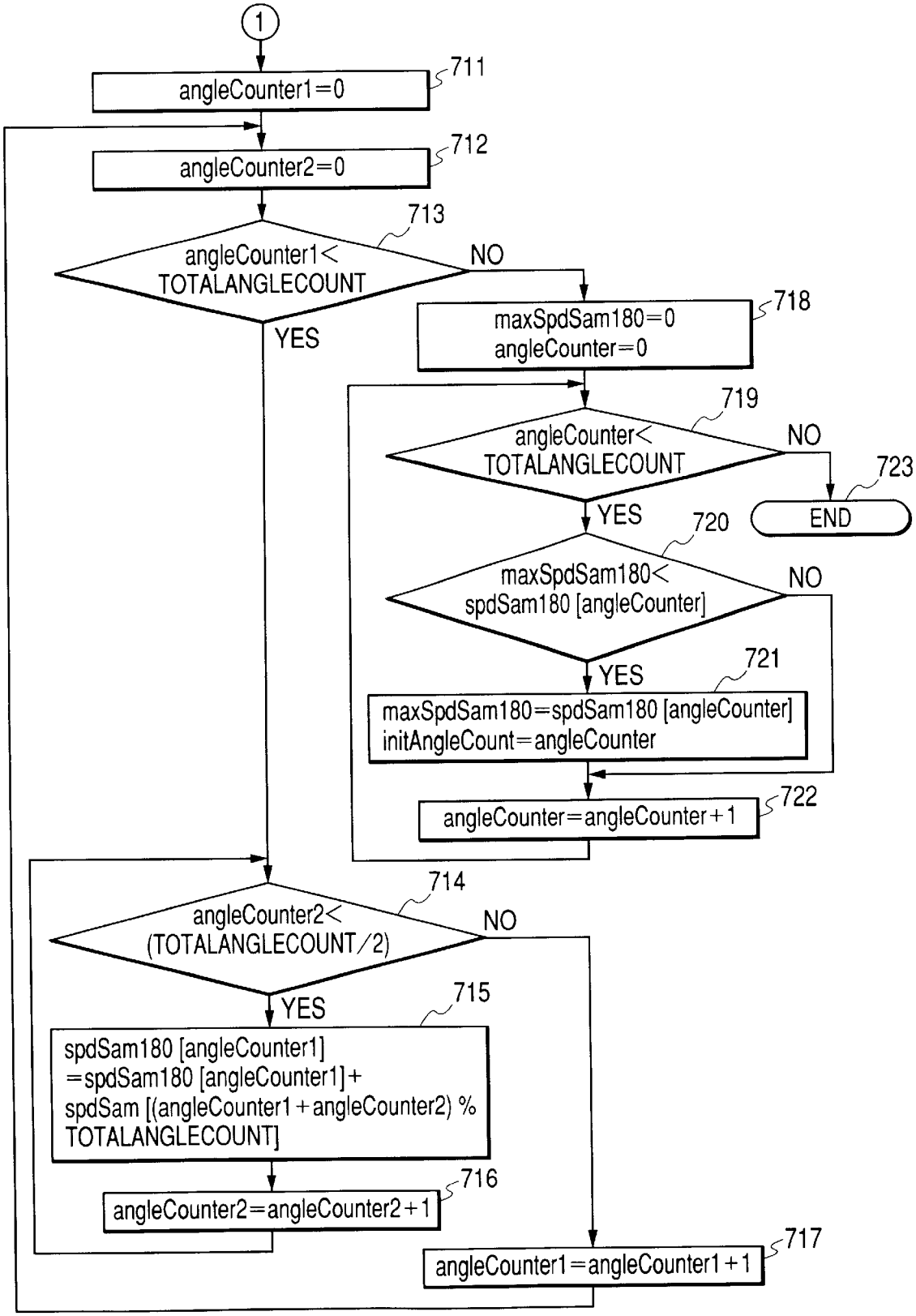

FIGS. 4A and 4B are flow charts showing a period profile detecting step and an origin judging step of correctly judging a specific phase angle in a period profile as an origin, which are the subjects of the present invention.

In case of explaining the flow chart of FIGS. 4A and 4B, FIGS. 5 to 8 are used to supplementally explain an operation conducted by the process based on this flow chart, on an actual speed changing profile, by way of example.

FIG. 5 shows an example of data representing, as a speed change ratio, a speed change detected for each encoder slit. Here, in an apparatus which has been designed so that 160 encoder slits just correspond to a period of motor cogging, i.e., in the apparatus in which 160 sample data can be obtained in the one-time cogging since a period 360° has been divided into 160 sections by 2.25°, the speed change is detected when the conveying roller is driven in a feedback control step of driving the roller at a constant speed.

Figure 6:
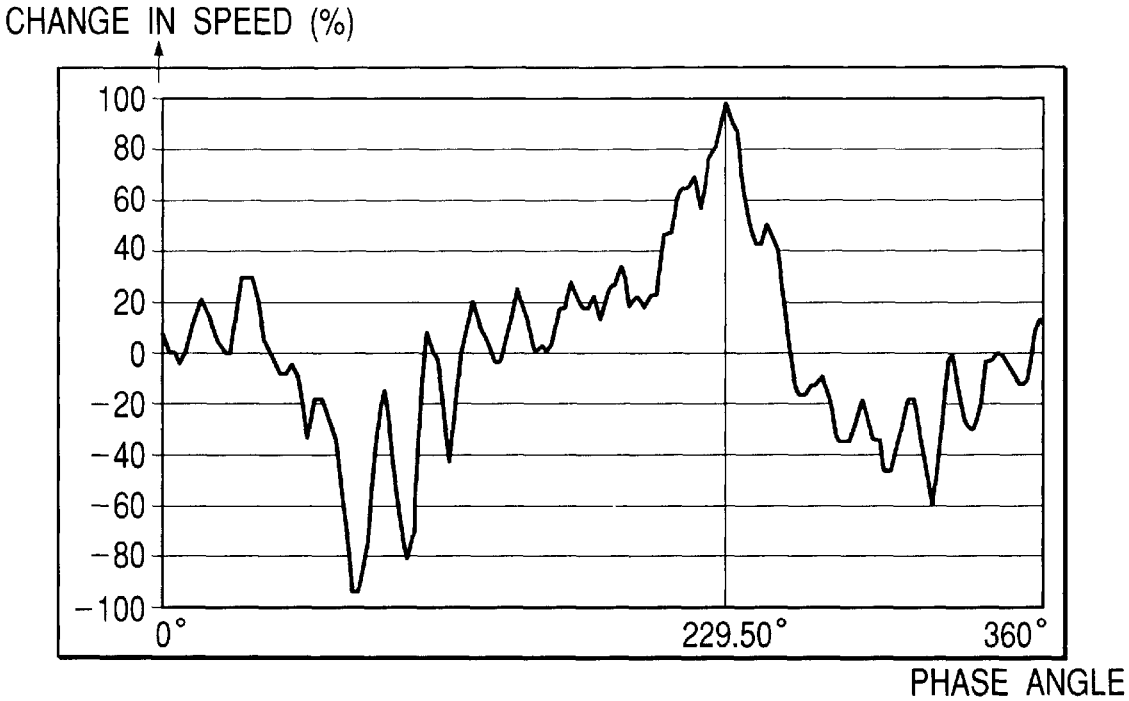
FIG. 6 is a data graph showing the speed change ratio detected for each encoder slit by executing the driving in the feedback control step of driving the conveying roller at the constant speed.

FIG. 6 is a graph showing the speed changes of FIG. 5, and in FIG. 6 the longitudinal axis indicates a phase angle and the lateral axis indicates the speed change ratio.

Figure 7:
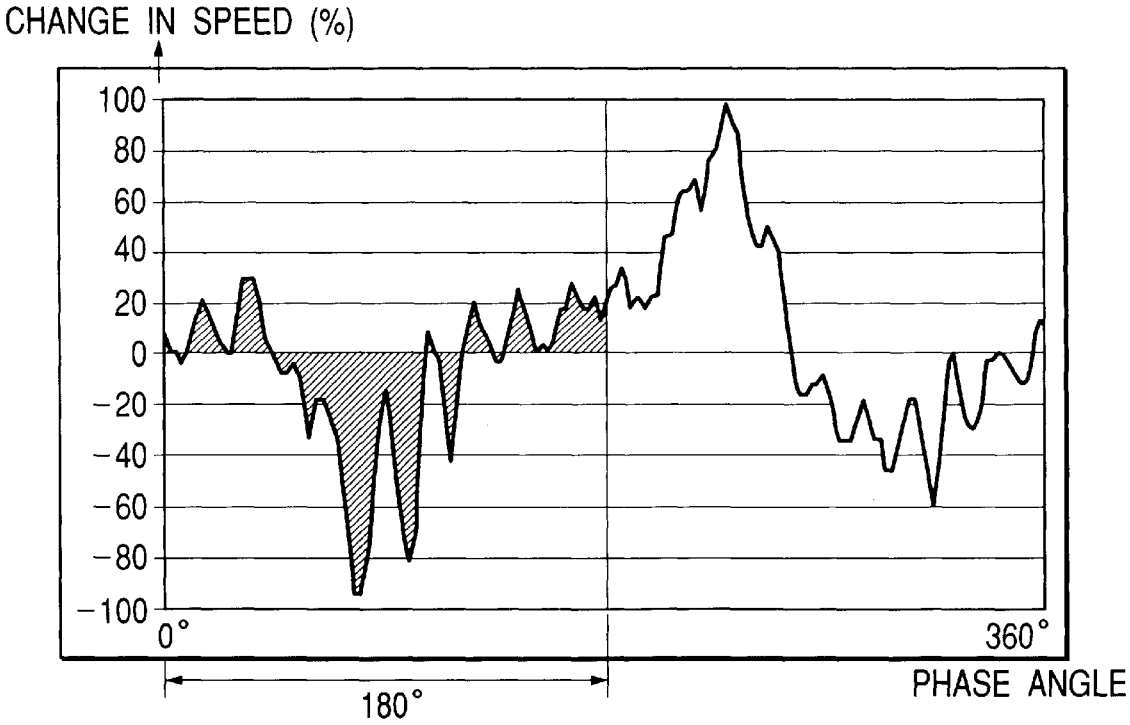
FIG. 7 is a graph for explaining a process of calculating the sum of the speed changes.
Figure 8:
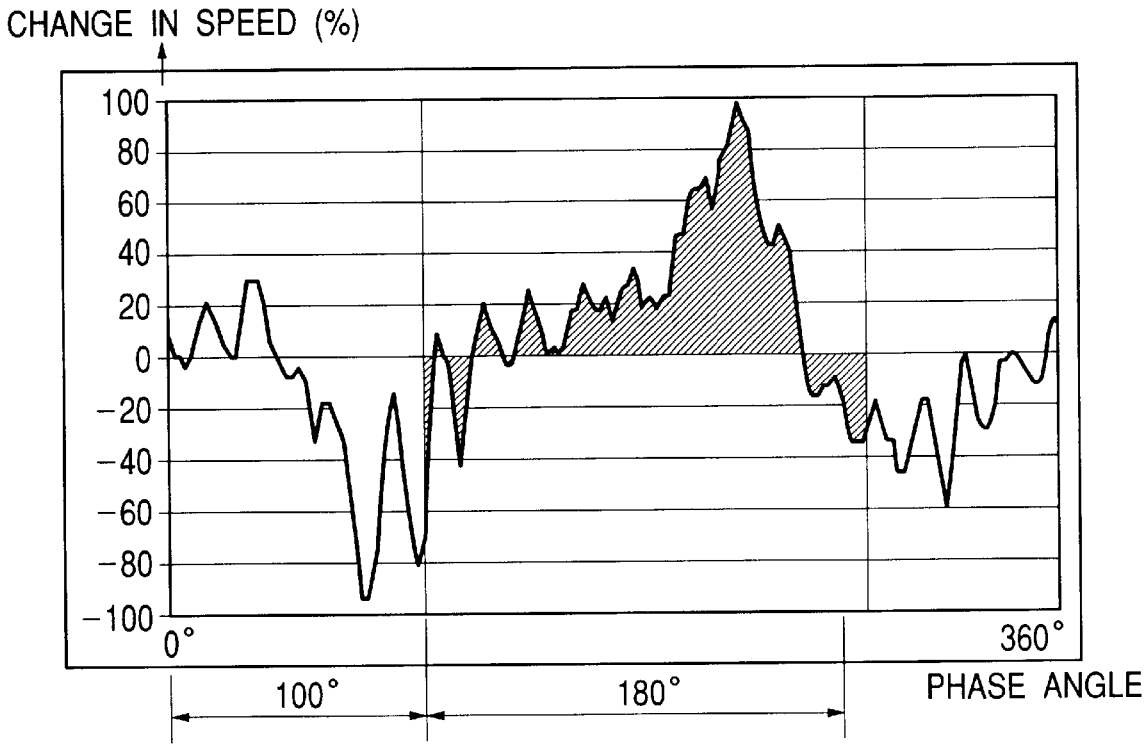
FIG. 8 is a graph for explaining the process of calculating the sum of the speed changes.

FIGS. 7 and 8 are graphs for explaining a process of calculating the sum of the speed changes for each unit phase range 180°. Concretely, the area of the parts painted black is calculated with signs. The sum of the speed changes within the range of 0° to 180° is obtained in FIG. 7, and the sum of the speed changes within the range of 100° to 280° is obtained in FIG. 8.

Next, constants, variables and the like used in FIGS. 4A and 4B will be explained.

In FIGS. 4A and 4B, steps 701 to 710 indicate the period profile detecting step and steps 711 to 723 indicate the origin judging step.

A constant TOTALANGLECOUNT represents the number of counted lines of the encoder which is necessary to count the distance corresponding to a period of the motor cogging. For example, this constant is given as "160" in the apparatus which has been designed so that the 160 encoder slits just correspond to a period of the motor cogging.

A constant TOTALSAMPLECOUNT represents the value for determining that data analysis should be executed by using the data corresponding to how many periods of the motor cogging. For example, if this constant is given as "5", the data analysis is executed by using the data corresponding to five periods of the motor cogging. Since speed change data is influenced by all-disturbance, an influence of instantaneous disturbance is directly reflected in the data analysis if the number of samples is not increased, whereby an objection to correct data analysis occurs. Thus, like this, it is preferable to overall analyze the data corresponding to several periods.

Actual driving speeds detected whenever the roller crosses the encoder slit are sequentially held in an array spdInfo[TOTALANGLECOUNT][TOTALSAMPLECOUNT].

An array spdSam[TOTALANGLECOUNT] is an area where the value obtained by adding all the data corresponding to the period TOTALSAMPLECOUNT is substituted for driving speed information of the same phase.

An array spdSam180[ANGLECounter1] is an area where the value obtained by calculating, by making a variable angleCounter1 a starting point, the sum of the array spdSam [TOTALANGLECOUNT] for each unit phase range (assumed as 180° here) on the period profile.

Each of variables angleCounter, angleCounter1 and angleCounter2 represents the number of counted lines of the encoder. For example, in the apparatus which has been designed so that the 160 lines of the encoder slits just correspond to a period of the motor cogging, the phase advances by 2.25° whenever the count advances by one.

A variable sampleCounter represents what order of period of sample the array being accessed is.

A variable maxSpdSam180 represents an area where the maximum value of the information in the array spdSam180 is stored.

A variable initAngleCount represents an area where the counted value of the lines of the encoder corresponding to the phase when the variable maxSpdSam180 is detected is substituted. In the following steps, the variable initAngleCount is used as the origin for correlating the period profile with the absolute numeric information obtained from the encoder.

In the following, the flow shown in FIGS. 4A and 4B will be explained.

If the process starts in the step 701, each area is initialized in the step 702.

In the step 703, in the feedback control step of driving the conveying roller at a constant speed, the driving of the period TOTALSAMPLECOUNT is executed, and the speed information corresponding to each encoder slit is stored in the array spdInfo.

The steps 704 to 710 show the process to generate the information in the array spdSam using the information in the array spdInfo.

The steps 711 to 717 show the process to generate the information in the array spdSam180 using the information in the array spdSam.

The steps 718 to 722 show the process to obtain, using the information in the array spdSam180, the variable initAngleCount used as the origin for correlating the period profile being the process target of this flow chart with the absolute numeric information obtained from the encoder.

Hereinafter, the concept of the process at which the flow charts of FIGS. 4A and 4B aims will be concretely explained with reference to FIGS. 5 to 8.

An apparatus in which the speed change profile in case of driving the conveying roller at a constant speed by the feedback control process comes to be as shown in FIGS. 5 and 6 is assumed. While the profile vibrates finely because control parameters are not completely identified in the feedback control step, the speed is too high in the vicinity of the phase angle 230°. That is, it is understood that a peak of the phase that the torque thickens most exists.

If the phase that the torque thickens most can be detected and made to the origin, it is possible in a print process to allow the period profile and the absolute numeric information obtained from the encoder to correspond uniquely.

Thus, as shown in FIG. 7, the sum of the speed changes is calculated and obtained for each unit phase range (assumed as 180° here). When the area of the parts painted black on the graph is calculated with positive and negative signs, the obtained value just indicates the sum of the speed changes. Therefore, if the areas of the respective parts are sequentially obtained from the left on the graph, e.g., for every 180° while shifting the area by 5°, and the process shown in FIGS. 4A and 4B is executed, it logically turns out that only the sum of the areas of the respective parts shown in FIG. 8 is finally the maximum value, whereby the origin can be determined. In FIG. 8, the origin may be positioned at the phase angle 100°. Although the case of determining the origin in the region where the sum of the areas is the maximum value is shown by way of example in the present embodiment, the present invention is not limited to this. That is, it is possible to determine the origin in a region where the sum of the areas is the minimum value, or it is possible to determine the origin in a region where the sum of the areas is within a certain arbitrary range.

Besides, in the above analysis, a driving distance of the conveying roller corresponding to 360° being a period of the detected period profile may be made a driving distance corresponding to one period of the cogging torque change of the conveying motor, or a distance equivalent to the lowest common multiple of the driving distance corresponding to one period of the cogging torque change of the conveying motor and a driving distance corresponding to a rotation of the conveying roller.

Figure 9:
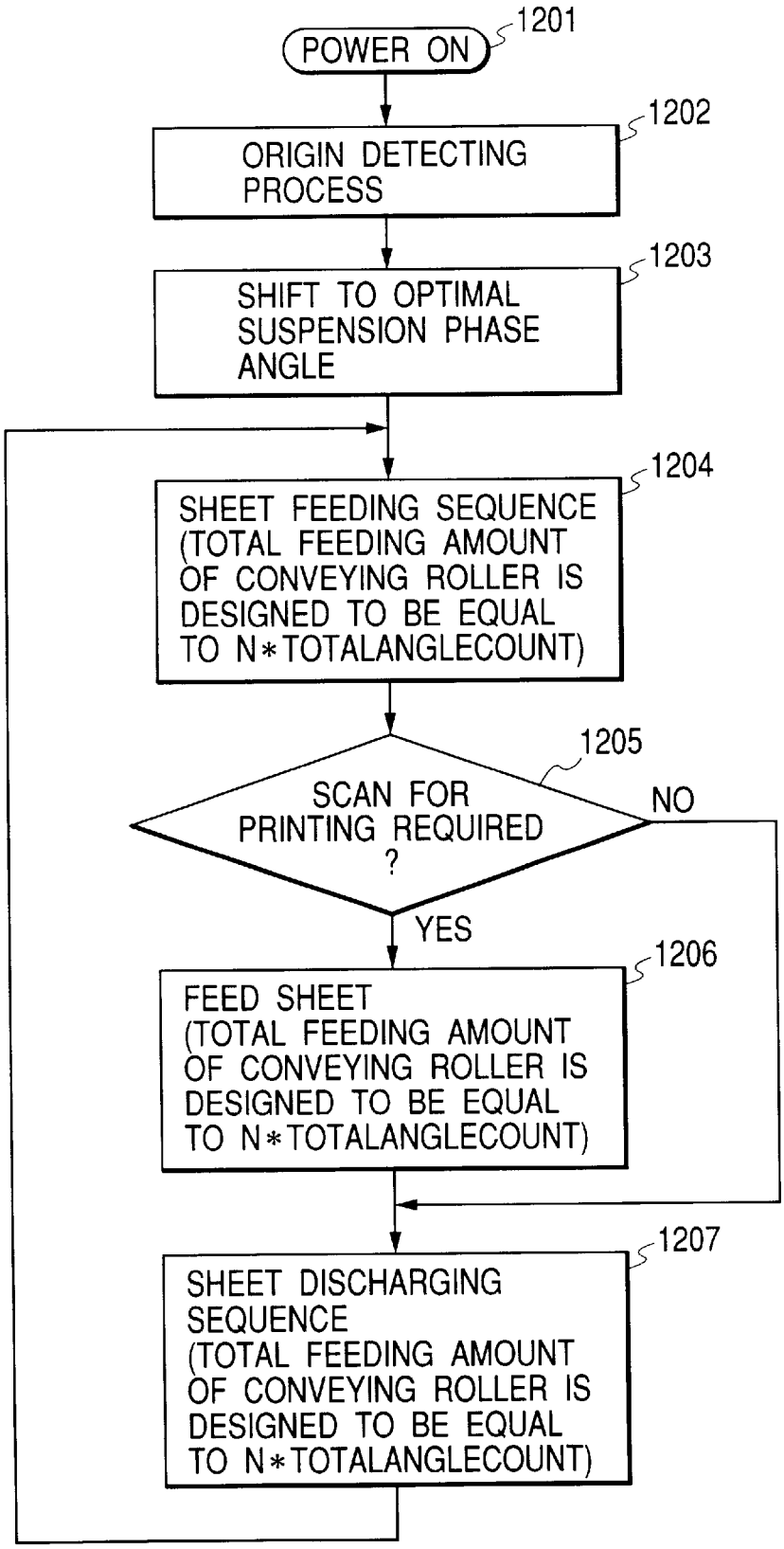
FIG. 9 is a flow chart showing a correlating step of correlating an offset phase angle having a specific offset from the origin with an optimal suspension phase angle being the phase angle to suspend or stop a sheet member conveying means, and a phase managing step of executing suspension phase angle control so that the suspension phase angle at which the sheet member conveying means suspends becomes the optimal suspension phase angle, according to the present invention.

FIG. 9 is a flow chart showing a correlating step of correlating an offset phase angle having a specific offset from the origin with an optimal suspension phase angle being the phase angle on the period profile to suspend or stop a sheet member conveying means, and a phase managing step of executing suspension phase angle control so that the suspension phase angle on the period profile at which the sheet member conveying means suspends becomes the optimal suspension phase angle, which are the subjects of the present invention.

If a process starts in a step 1201, the process explained in FIGS. 4A and 4B is executed in a step 1202 to detect the origin.

Then, in a step 1203, from the origin obtained in the step 1202 as the starting point, the phase angle is shifted to the position which has been examined beforehand that it is the optimal suspension phase angle most desirable in control in the individual of the recording apparatus. Hereinafter, the concept of this optimal suspension phase angle will be confirmed again with reference to FIGS. 13 and 14.

Figure 13:
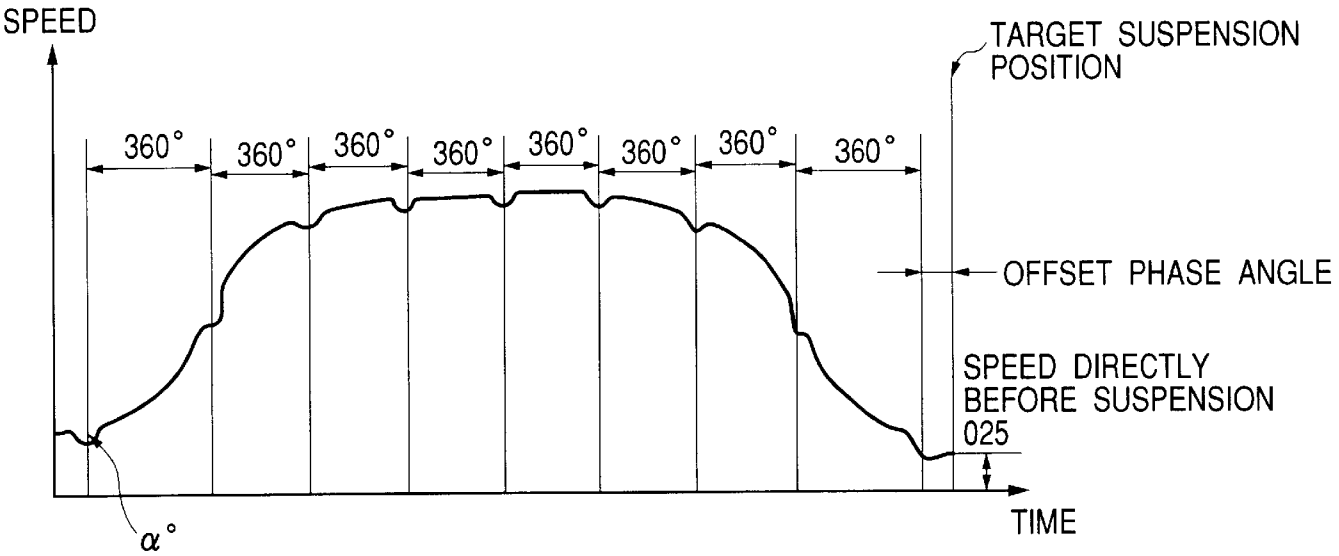
FIG. 13 is a graph schematically showing an actual operation in a case where the DC motor controlled aiming at the ideal profile as shown in FIG. 12 is influenced by the torque change due to the cogging.
Figure 14:
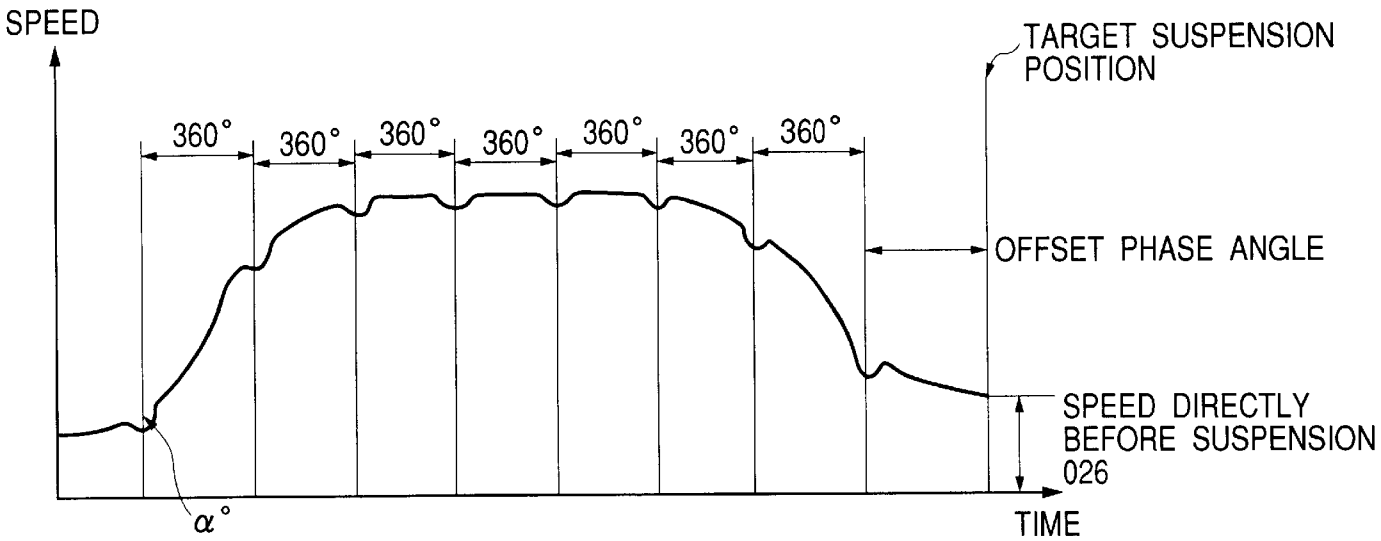
FIG. 14 is a graph schematically showing another example of the actual operation in the case where the DC motor controlled aiming at the ideal profile as shown in FIG. 12 is influenced by the torque change due to the cogging.

For example, in the case of considering a settling time as more important, FIG. 14 is preferable. Because, since in FIG. 14 the rotated motor reaches the suspension position after passing enough phases from the passing of the angle α° a speed directly before the suspension position can be increased. On the other hand, in the case of considering suspension accuracy as more important, FIG. 13 is preferable. Because, since in FIG. 13, the rotated motor reaches the suspension position more promptly after passing the angle α°, the speed directly before the suspension position can be decreased. The offset phase angle from the passing of the angle α° to the suspension position is the value which is determined by tuning examined beforehand in a design process of the recording apparatus, whereby an explanation for such a determining method will be omitted in the present embodiment. Although the present invention relates to a means for always keeping the offset phase angle between the suspension phase angle being a target driving suspension position and the angle α° to have the same value, it is possible to execute the recording while securing the desired conveying speed or the desired suspension position accuracy, by in the correlating step, as before-mentioned, correlating the offset phase angle at which the sheet member can be conveyed at a desired conveying speed as the optimal suspension phase angle, or by in the correlating step, correlating the offset phase angle at which the sheet member can be conveyed in desired suspension position accuracy as the optimal suspension phase angle.

Steps 1204 to 1207 explain that the offset phase angles between every target driving suspension position of the conveying roller and the angle α°, in the operation of the recording apparatus, are all kept equal to the offset phase angle in the step 1203.

A sheet feeding sequence is executed in the step 1204. Here, by designing beforehand the total driving (feeding) amount of the conveying roller to be equal to an integer multiple (N) of the constant TOTALANGLECOUNT, the offset phase angle between the target driving suspension position and the angle α° at the time when the sheet feeding sequence ends can be kept equal to the offset phase angle in the step 1203.

If a scan for printout is required in the step 1205, a sheet feeding process for the printing is executed in the step 1206. Here, by designing beforehand the total driving (feeding) amount of the conveying roller to be equal to an integer multiple (N) of the constant TOTALANGLECOUNT, the offset phase angle between the target driving suspension position and the angle α° at the time when the sheet feeding sequence ends can be kept equal to the offset phase angle in the step 1203. To achieve the above, for example, it is preferable to adopt a method of matching the conveying amount of the recording medium with a cogging torque ripple period of the motor. It should be noted that this method will be described later.

A sheet discharging sequence is executed in the step 1207. Here, by designing beforehand the total driving (feeding) amount of the conveying roller to be equal to an integer multiple (N) of the constant TOTALANGLECOUNT, the offset phase angle between the target driving suspension position and the angle α° at the time when the sheet discharging sequence ends can be kept equal to the offset phase angle in the step 1203.

Figure 10:
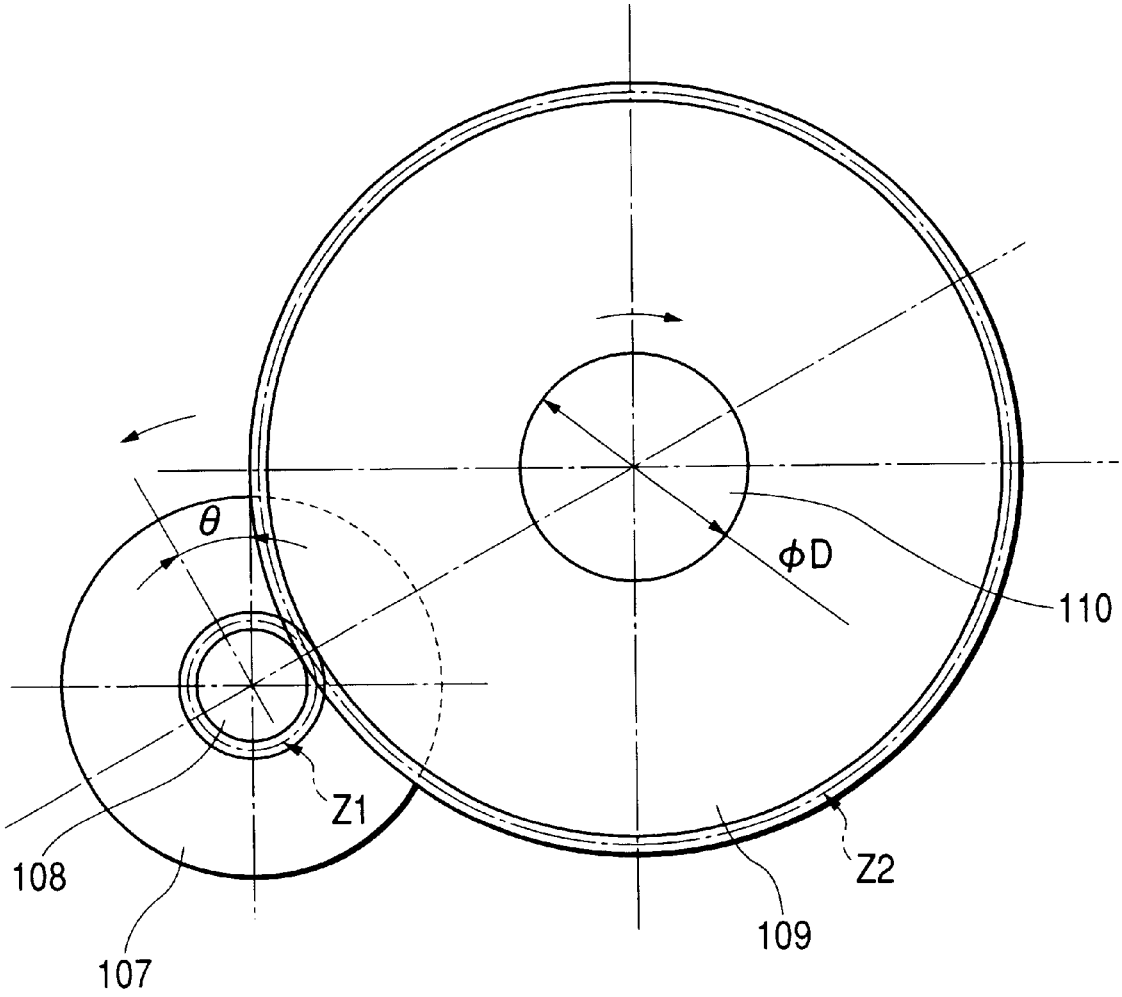
FIG. 10 is a diagram for explaining a structure of a driving transmission means according to the present invention.
Figure 11:
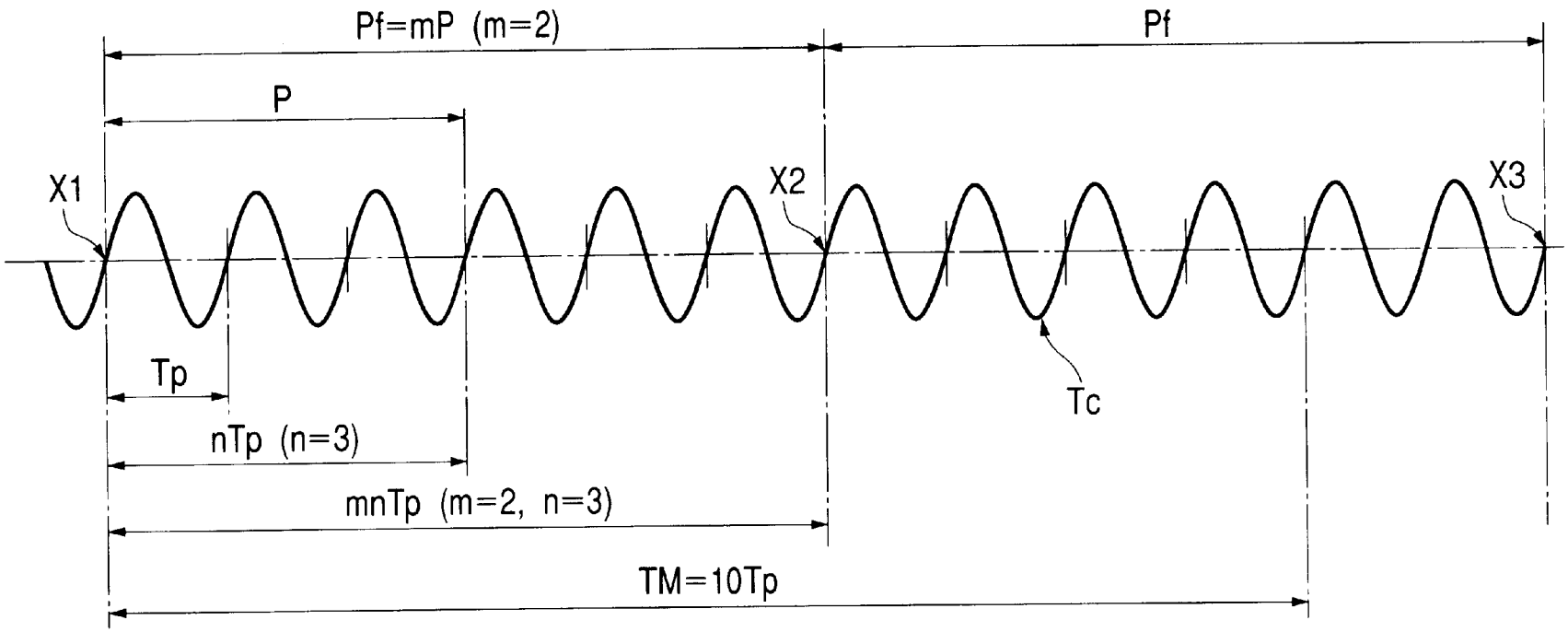
FIG. 11 is a diagram showing relation between a cogging torque ripple of a conveying motor and a recording sheet conveying amount by a conveying roller, according to the present invention.
Figure 12:
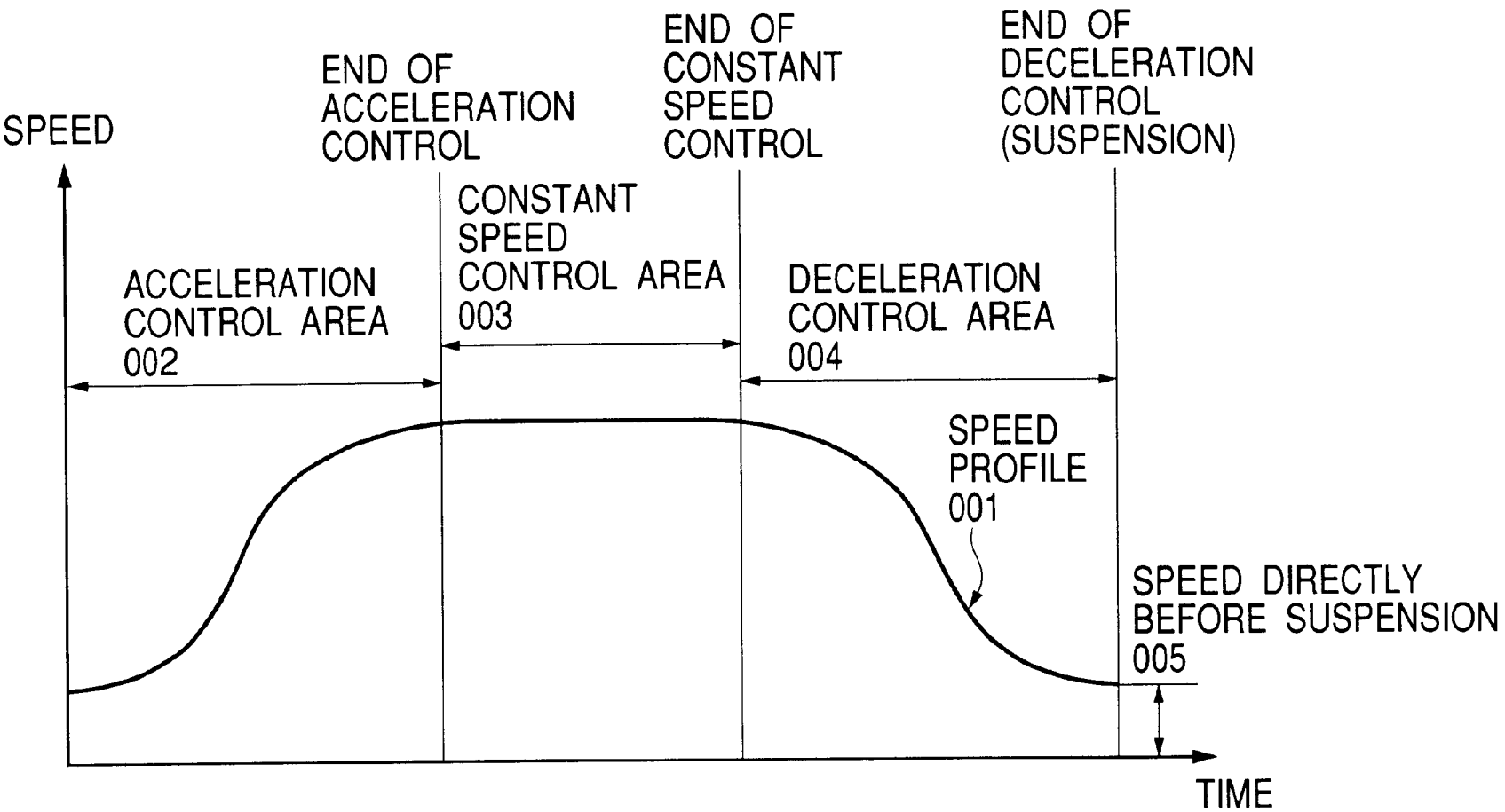
FIG. 12 is a graph showing an ideal state of a driving profile of a general DC motor in a case where tracking (or variable-value) control is used as the feedback control.

Next, a recording apparatus which has been designed so that the total driving (feeding) amount of the conveying roller to be equal to an integer multiple (N) of the constant TOTALANGLECOUNT will be explained by way of example. FIG. 10 is a diagram for explaining the structure of the driving transmission means, and FIG. 11 is a diagram showing relation between a cogging torque ripple of the DC motor and the recording sheet conveying amount by the conveying roller. It should be noted that in the following explanation the parts same as those in FIG. 1 are added with the same numerals respectively.

In FIG. 10, it is assumed that the number of teeth of the motor gear 108 is given by Z1, the number of teeth of the conveying roller gear 109 is given by Z2, and the conveying diameter of the conveying roller 110 is given by $\phi D$. Here, if the conveying motor 107 is rotated by a certain angle $\theta$, the recording sheet 115 is conveyed with the conveying roller 110 by $\pi D\times(Z1/Z2)\times(\theta/2\pi)$.

In the graph of FIG. 11, the longitudinal axis indicates torque (or may indicate speed), and the lateral axis indicates the recording sheet conveying amount by the conveying roller. According to the characteristic of the DC motor, for example, if the DC motor having a two-pole magnet and five slots is used, ten-period torque changes (cogging torque ripples) arise in a period TM of one rotation of the motor because of balance of magnetic force as shown in FIG. 11. That is, a similar torque change period Tp arises every 1/10 period of the motor. Although the torque changes (or the speed changes) might be slightly different from others due to a loss by axial eccentricity of the motor, mechanical balance and electrical balance, this periodicity is not greatly degraded because the period itself is determined by the structure of the motor.

Here, a basic minimum conveying pitch P used in the intermittent sheet conveying or the like when the image is formed is matched with an integer multiple of the conveying amount Tp corresponding to one period of the cogging torque ripple (or the speed change due to cogging) ($P=n\times Tp$, n is an integer). Incidentally, it should be noted that the conveying amount Tp is obtained by converting the constant TOTALANGLECOUNT (e.g., the number of counts "160" in the above example) into a distance. Further, a whole conveying amount Pf capable of being in existence in each mode is matched with an integer multiple of the basic minimum conveying pitch P ($Pf=m\times P$, m is an integer).

Then, if it is assumed that a cogging torque ripple angle period of the motor is given by $\theta t$ (rad), the conveying amount Pf is given by a following expression.

$$Pf=m\times P=m\times n\times Tp=m\times n\times\pi\times D\times(Z1/Z2)\times(\theta t/2\pi) \quad (1)$$

(where m and n are integers, and m=2 and n=3 in FIG. 11).

If a deceleration ratio to satisfy the above expression is determined (i.e., if the number of teeth Z1 and the number of teeth Z2 are determined), as shown in FIG. 11, when the conveying of the determined conveying pitch Pf is executed, a cogging torque ripple phase angle at the motor suspension or stop is always constant. When the motor is at a position X1, the motor shifts to a position X2 if the conveying of the pitch Pf is executed, and the motor further shifts to a position X3 if the conveying of the pitch Pf is further executed. Each suspension point is at the same-phase position on a cogging torque ripple Tc.

As a result, the cogging torque causing disturbance at each suspension position is always similar or approximate, and also pre-suspension disturbance torque is approximate every time the motor suspends, whereby servo-controlled speed is substantially constant. Thus, since such two conditions are stable, also the motor suspension position is stable.

If the cogging torque ripple phase angle is different at each motor suspension, the suspension position deviates from the suspension target (OFF timing for stopping driving of the DC motor). However, if the cogging torque ripple phase angle is the same at each conveying, the suspension position is substantially the same every time the motor suspends, whereby accuracy of the conveying pitch being the relative suspension position can be secured. That is, in FIG. 11, although the phase angle at each conveying pitch Pf is always 0°, the phase angle itself need not be 0°. Thus, even if another phase angle (e.g., 45°, 90°, 135° or the like) is given, it may be employed on the condition that such the phase angle be always constant.

In the above expression (1), if n=the number of slots of the motor×2, the basic minimum conveying pitch P is equal to the period TM of one rotation of the motor, whereby the motor can suspend in the state that, as well as the period of the cogging torque ripple (cogging period), a motor one-cycle torque change (a torque change in one period of the motor) due to the loss by axial eccentricity of the motor or the motor structure is always the same, thereby further increasing accuracy.

Although m=2 and n=3 are given by way of example, the present embodiment is not limited to these values. That is, the value m only has to be an integer even if the conveying amount becomes variable during the recording, and the value n only has to be an integer even when the deceleration ratio is determined. Further, the number of magnetic poles of the DC motor and the number of slots are not limited to the values described in the present embodiment.

In this method, a deceleration ratio only has to be set, and encoder information of the excessively small pitch used to strictly control the cogging period is not necessary, whereby neither special parts nor the control are necessary. For this reason, restriction on the size of a codewheel and a kind of encoder is small, whereby there is a significant merit that the conveying of high accuracy can be achieved cheaply and easily.

Further, although in the present embodiment the whole conveying amount Pf is matched with the integer multiple of the conveying amount Tp corresponding to one period of the change due to the cogging, the whole conveying amount Pf need not necessarily be matched and the speed may be preferentially set in a skip conveying mode where an adjacent image area does not exist, in a high-speed recording mode where image quality is no object, and the like.

In the present embodiment, the one-step deceleration gear as shown in FIG. 10 has been explained by way of example. However, with respect to a multi-step deceleration gear train, similarly, the basic minimum conveying pitch of the sheet can be easily matched with an integer multiple of the sheet conveying amount by the rotation of the conveying motor corresponding to one period of the cogging torque ripple of the motor. Further, even in case of using a belt having gear teeth (a cogged belt or a timing belt) as the driving transmission means, it is apparent that the same effect as above can be obtained by replacing the above gear with a cogged-belt pulley, and such a modification does not at all deviate from the scope of the present invention.

Further, in the present embodiment, the case where the driving distance of the conveying roller corresponding to a period 360° of the period profile is made the driving distance corresponding to one period of the cogging torque change of the conveying roller acting as the DC motor has been explained by way of example. However, it is effective to make the driving distance to correspond to a kind of object, if this object is a characteristic change having periodicity. For example, the driving distance may be made a distance equivalent to the lowest common multiple of the driving distance corresponding to one period of the cogging torque change of the conveying motor acting as the DC motor and a driving distance corresponding to a rotation of the conveying roller. Further, in the DC motor having the two-pole magnet and the five slots as shown in FIGS. 10 and 11, it is assumed to use a coarse motor in which there is loss by axial eccentricity of the motor, mechanical and electrical structures are extremely out of balance, and similarity of the torque change period Tp for every 1/10 period is deteriorated. In this case, it is needless to say that, even if such a coarse motor is used, the effect of the present invention can be enjoyed by setting the driving distance to have one period of the cogging torque change×2×5.

As described above, according to the present embodiment, before the sheet member is conveyed, the periodic speed change or torque change of the sheet member conveying apparatus is detected beforehand as the period profile, and the specific phase angle in the period profile is also detected beforehand as the origin. Further, the offset phase angle is correlated with the optimal suspension phase angle, and also the suspension phase angle is controlled so that the suspension phase angle at which the sheet member conveying apparatus suspends becomes the optimal suspension phase angle. That is, the control is continued by keeping always constant and optimal the relative offset phase angle between the phase angle of the periodic speed change or torque change and the suspension phase angle being the target driving suspension position, whereby it is possible to eliminate that the high-frequency torque change represented by the motor cogging period influences suspension accuracy performance and settling time performance of the sheet member conveying means.

What is claimed is:

1. A control method for a sheet member conveying apparatus which has a conveying roller for conveying a sheet member, a conveying motor for generating a driving force to drive said conveying roller, driving transmission means for transmitting the driving force of said conveying motor to said conveying roller, and detecting means for detecting a position and a speed of said conveying roller, comprising:

a period profile detecting step of detecting a periodic speed change or torque change of said conveying roller as a period profile;

an origin judging step of judging a specific phase angle in said period profile as an origin;

a correlating step of correlating an offset phase angle having a specific offset from said origin with an optimal suspension phase angle on said period profile, said optimal suspension phase angle being a phase angle to suspend said conveying roller; and a phase managing step of controlling the suspension phase angle so that the suspension phase angle on said period profile at which said conveying roller is suspended becomes said optimal suspension phase angle.

2. A method according to claim 1, wherein said period profile detecting step includes a feedback control step of driving said conveying roller at a constant speed; and a step of analyzing at a specific period the conveying speed of said conveying roller at a plurality of encoder positions detected by an encoder of said detecting means, and then making the analyzed speed said period profile, in said feedback control step.

3. A method according to claim 2, wherein said conveying motor is a DC motor.

4. A method according to claim 3, further comprising a step of making a driving distance of said conveying roller corresponding to said specific period a driving distance corresponding to one period of a cogging torque change of said conveying motor.

5. A method according to claim 3, further comprising a step of making a driving distance of said conveying roller corresponding to said specific period a distance equivalent to the lowest common multiple of a driving distance corresponding to one period of a cogging torque change of said conveying motor and a driving distance corresponding to one rotation of said conveying roller.

6. A method according to claim 1, wherein, in said origin judging step, said specific phase angle within a unit phase range where the sum of detected values for each said unit phase range on said period profile is maximum is judged as said origin.

7. A method according to claim 1, wherein, in said origin judging step, said specific phase angle within a unit phase range where the sum of detected values for each said unit phase range on said period profile is minimum is judged as said origin.

8. A method according to claim 1, wherein, in said correlating step, said offset phase angle at which the sheet member can be conveyed at a desired conveying speed is correlated as said optimal suspension phase angle.

9. A method according to claim 1, wherein, in said correlating step, said offset phase angle at which the sheet member can be conveyed in desired suspension position accuracy is correlated as said optimal suspension phase angle.

10. A method according to claim 1, wherein, in said phase managing step, a conveying amount of the sheet member by said conveying motor is made an integer multiple of a conveying amount of the sheet member by rotation of said conveying roller corresponding to a period of the speed change or torque change caused by said conveying motor or said driving transmission means.

11. A control method for a recording apparatus which has a conveying roller for conveying a sheet member, a conveying motor for generating a driving force to drive said conveying roller, driving transmission means for transmitting the driving force of said conveying motor to said conveying roller, and detecting means for detecting a position and a speed of said conveying roller, and which executes recording on the sheet member by a recording head, said method comprising:

a period profile detecting step of detecting a periodic speed change or torque change of said conveying roller as a period profile;

an origin judging step of judging a specific phase angle in said period profile as an origin;

a correlating step of correlating an offset phase angle having a specific offset from said origin with an optimal suspension phase angle on said period profile, said optimal suspension phase angle being a phase angle to suspend said conveying roller; and a phase managing step of controlling the suspension phase angle so that the suspension phase angle on said period profile at which said conveying roller is suspended becomes said optimal suspension phase angle.

12. A method according to claim 11, wherein said period profile detecting step includes a feedback control step of driving said conveying roller at a constant speed; and a step of analyzing at a specific period the conveying speed of said conveying roller at a plurality of encoder positions detected by an encoder of said detecting means, and then making the analyzed speed said period profile, in said feedback control step.

13. A method according to claim 12, wherein said conveying motor is a DC motor.

14. A method according to claim 13, further comprising a step of making a driving distance of said conveying roller corresponding to said specific period a driving distance corresponding to one period of a cogging torque change of said conveying motor.

15. A method according to claim 13, further comprising a step of making a driving distance of said conveying roller corresponding to said specific period a distance equivalent to the lowest common multiple of a driving distance corresponding to one period of a cogging torque change of said conveying motor and a driving distance corresponding to one rotation of said conveying roller.

16. A method according to claim 11, wherein, in said origin judging step, said specific phase angle within a unit phase range where the sum of detected values for each said unit phase range on said period profile is maximum is judged as said origin.

17. A method according to claim 11, wherein, in said origin judging step, said specific phase angle within a unit phase range where the sum of detected values for each said unit phase range on said period profile is minimum is judged as said origin.

18. A method according to claim 11, wherein, in said correlating step, said offset phase angle at which the sheet member can be conveyed at a desired conveying speed is correlated as said optimal suspension phase angle.

19. A method according to claim 11, wherein, in said correlating step, said offset phase angle at which the sheet member can be conveyed in desired suspension position accuracy is correlated as said optimal suspension phase angle.

20. A method according to claim 11, wherein, in said phase managing step, a conveying amount of the sheet member by said conveying motor is made an integer multiple of a conveying amount of the sheet member by rotation of said conveying roller corresponding to a period of the speed change or torque change caused by said conveying motor or said driving transmission means.

21. A method according to claim 11, wherein said recording apparatus is an ink jet recording apparatus.

22. A method according to claim 11, wherein said recording apparatus is a serial recording apparatus which scans a carriage equipped with the recording head and thus forms an image while intermittently conveying the sheet member.

* * * * *